US007639830B2

(12) United States Patent
Schell et al.

(10) Patent No.: US 7,639,830 B2
(45) Date of Patent: Dec. 29, 2009

(54) APPARATUS FOR ACOUSTIC LOADING OF A DIAPHRAGM

(75) Inventors: Stephen Frederick Schell, Long Beach, CA (US); Richard Janis Drysdale, Anaheim, CA (US)

(73) Assignee: Cogent True-To-Life Loudspeakers, Incorporated, Anaheim, CA (US)

( * ) Notice: Subject to any disclaimer, the term of this patent is extended or adjusted under 35 U.S.C. 154(b) by 870 days.

(21) Appl. No.: 11/366,912

(22) Filed: Mar. 2, 2006

(65) Prior Publication Data

US 2007/0217646 A1 Sep. 20, 2007

(51) Int. Cl.
*H04R 25/00* (2006.01)

(52) U.S. Cl. ..... 381/343; 381/337; 381/340

(58) Field of Classification Search ..... 381/337, 381/339, 340, 341, 342, 343; 181/152, 159, 181/175, 185, 192, 195, 199
See application file for complete search history.

(56) References Cited

U.S. PATENT DOCUMENTS 2,037,187 A * 4/1936 Wente
2,183,528 A * 12/1939 Blackburn
2,832,844 A * 4/1958 Matsuoka
4,050,541 A * 9/1977 Henricksen
4,157,741 A * 6/1979 Goldwater ..... 381/342
4,975,965 A * 12/1990 Adamson ..... 381/343
5,117,462 A * 5/1992 Bie
6,064,745 A * 5/2000 Avera ..... 381/343
6,744,899 B1 * 6/2004 Grunberg ..... 381/343

OTHER PUBLICATIONS

M.C. Batsel and C.N. Reifsteck, Photophone and Test Equipment Division of RCA Manufacturing Co.; "Reproducing Equipment for Motion Picture Theatres"; *RCA Review magazine*; Jan. 1937.*

* cited by examiner

*Primary Examiner*—Huyen D Le

(57) ABSTRACT

An apparatus acoustic loading of a diaphragm is disclosed. The apparatus comprises a rear face having a shape corresponding to a shape of a compression side of the diaphragm, a front face opposite to the rear face along an axis of symmetry, and a plurality of voids formed between the rear face and the front face. The plurality of voids are arranged so that their intersection with rear face forms a plurality of inlets, the plurality of inlets defining a higher compression ratio in the proximity of a voice coil compared to a compression ratio defined in at least a portion of the remaining area of the diaphragm.

12 Claims, 6 Drawing Sheets

APPARATUS FOR ACOUSTIC LOADING OF A DIAPHRAGM

BACKGROUND

1. Field

The present invention relates to transducers of electrical energy to acoustic energy and vice versa. More particularly, the present invention relates to an apparatus for acoustic loading of a diaphragm in such a transducer.

2. Background

Transducers have been developed to allow transformation of electrical energy into acoustic energy, as well as to allow transformation of acoustic energy into electrical energy. The former are known as loudspeaker drivers, the latter are known as microphones.

Among the many considerations when designing such transducers is efficiency of energy transformation. To accomplish such an energy transformation, a transducer typically comprises a moving element—a diaphragm. In a driver, the moving element is responsive to the electrical energy. In a microphone, the moving element is responsive to the acoustic energy. Because of different properties, e.g., masses, between the media through which the acoustic energy propagates, e.g., air, and the moving element of a transducer, i.e., the diaphragm, the energy transformation efficiency is small.

To improve the energy transformation efficiency, designers construct the diaphragm from light materials in an attempt to minimize the diaphragm's mass, thus decreasing the mismatch of the properties. However, this design approach is limited by a multiplicity of factors, including, but not being limited to: properties of the diaphragm material, properties of the diaphragm structure, acoustic loading on the diaphragm, and frequency of operation. Even advanced materials used for diaphragm construction reach a point, beyond which further attempts to decrease the diaphragm's mass causes the diaphragm to change its shape during operation, which results in non-pistonic movement and; consequently, an erratic acoustic or electrical energy output. The term pistonic means that each point at the diaphragm keeps constant position relative to the other points at the diaphragm, as the diaphragm moves.

Another technique to improve the energy transformation efficiency used in the art is to increase acoustic loading, or radiation resistance, acting upon the diaphragm. This loading is achieved by placing an acoustic transformer in front of the diaphragm.

One known class of acoustic transformers comprises horns. In general, a horn is a device, which achieves the acoustic transformation by converting large pressure variations in a small amount of air into a low pressure variation in a large amount of air. The conversion is effected by increasing cross-section area in the progression from a throat of the horn to the mouth of the horn, according to a function describing the horn's flare. Modern horn designs typically feature some form of flare, e.g., exponential, tractrix, or conical.

Very often, the loading is further modified by making the cross-section area of the horn throat smaller than the area of the diaphragm of the transducer to which the horn is attached. The relationship of the horn throat cross-section area to the diaphragm area is typically referred to as a compression ratio of the horn.

Although the above-described horn improves efficiency of the energy transformation, the acoustic energy being radiated from different locations on the diaphragm in a form of sound waves, may arrive in the horn throat at different times due to differing path lengths. Such an arrival creates an out of phase condition causing irregularities in the frequency response.

A solution to this problem is to make paths from different parts of the diaphragm as similar as possible, to avoid phase cancellation that results from such an out of phase condition. One such a solution utilizes an acoustic transformer known as a phase—or phasing—plug, which is interposed between the diaphragm and the horn. A phasing plug thus improves loading of a diaphragm, and equalizes path lengths.

Reference is now made to FIG. 1, which illustrates a transducer in accordance with a general construction principles of prior art. Although FIG. 1 illustrates a driver, such is for tutorial purposes only because the below described concepts are equally applicable to microphones.

The transducer comprises an acoustic transformer, i.e., a phasing plug 102. The acoustic transformer possesses rotation symmetry about an axis 100. The axis of rotation is a line such that for every point of the body its distance to the line remains constant under the rotation, and the point remains in the same plane perpendicular to the axis. Thus the point moves in a circle in that plane.

A rear face 106 of the phasing plug 102 is shaped in accordance with the shape of a diaphragm 108, generally in a shape of a dome, or a portion of a sphere. To enable movement of the diaphragm 108, a surround 124 is attached in vicinity to the circumference of the diaphragm 108. The surround 124 operates like a suspension as well as locating device for the diaphragm 108, and is affixed to a first pole piece 110, by fasteners 112.

Because an acoustic capacitance of volume of air between the diaphragm 108 and the phasing plug 102 causes loss of high frequency energy, the clearance between the rear face of the phasing plug 102 and the diaphragm 108 is generally defined to allow only enough room for the diaphragm to move through the diaphragm's intended range without physical interference with the rear face. Such an arrangement minimizes the volume of air between the diaphragm and the phasing plug and; consequently, the acoustic capacitance.

The side of the diaphragm 108 facing the rear side of the phasing plug 102 is a compression side of the diaphragm. The non-compression side of the diaphragm 108 is protected by a cover 126, either sealed or vented.

To enable movement of the diaphragm 108 and; consequently, a transformation of electrical energy to acoustic energy and vice versa, a voice coil 122 is affixed in vicinity to the circumference of the compression side of the diaphragm 108.

A static magnetic flux is provided so that an alternating input signal causing a current flow through the voice coil 122, causes the voice coil 122 to move back and forth along the axis 100. A magnetic circuit, i.e., a closed path containing the static magnetic flux, comprises the first pole piece 110, a second pole piece 116, and pieces 118 and 119. The materials and methods of mechanical connection of the pieces 110, 116, 118 and 119, forming the magnetic circuit are designed to provide a low reluctance path for the static magnetic flux through the magnetic circuit.

The static magnetic flux in the magnetic circuit is induced by a magnet 120, a coil, or any other suitable means. The static magnetic flux produces a magnetic flux density in the air gap between the first pole piece 110 and the second pole piece 116.

A plurality of voids 114 between the rear face 106 and the front face 104 form air channels, allowing the sound waves to travel through the voids 114 from rear to front, and generally emerge at the front face 104 of the phasing plug 102 as a single air channel.

To improve the loading of the diaphragm 108, the total cross-section area of the air channels of the phasing plug 102 at the rear face 108 is made smaller than the total area of the diaphragm 108. The relationship of the total diaphragm area to the total cross-section area of the air channels is typically referred to as a compression ratio of the transducer. The air between the diaphragm and the phasing plug (i.e., the compression region), can be compressed to relatively high pressures by small motion of the diaphragm. This is what allows such a transducer to output acoustic energy at greater pressure levels than can conventional loudspeakers where the diaphragm radiates directly into the air. The efficiency of the transducer is thus increased. A transducer with such an arrangement is generally referred to as a compression driver.

Further to providing a compression ratio, the path lengths of the air channels within the phasing plug may be equalized so as to bring all portions of the sound wave, propagating through the air channels, into phase coherence when they reach the front face of the phasing plug. Without such path length equalization, sound waves emanating from different air channels would destructively combine so as to cause irregularities in the frequency response as discussed above.

The exit path of the transducer is bored into a second pole piece 116. The area of the front face 104 and the area of a transducer's exit 128 together with the distance between them define a flare. This flare may affect the useful frequency bandwidth of the transducer.

There are many designs of phasing plugs, accomplishing the compression loading and path length equalization. Perhaps the most frequently used type is a circumferential phasing plug. Such a phasing plug comprises annular cross-sections that usually increase in area as the principal radius of each annulus decreases in moving toward the throat of the transducer. An example of such a phasing plug can be found in U.S. Pat. No. 2,037,187, entitled "Sound Translating Device," incorporated by reference. An often cited disadvantage of these phasing plugs—difficult and expensive manufacturing—lead to development of a radial phasing plug.

A radial phasing plug comprises a plurality of radial slot-shaped inlets extending from the axis of cylindrical symmetry of the speaker. An example of such a phasing plug can be found in U.S. Pat. No. 4,050,541, entitled "Acoustical Transformer for Horn-type Loudspeaker," incorporated by reference.

Yet another type is a saltshaker design, so called because holes at the spherical outer surface of the plug that extend through to the throat of the speaker resemble the holes of a saltshaker. An example of a saltshaker phasing plug may be found in Fancher M. Murray: "An Application of Bob Smith's Phasing Plug," 61$^{st}$ Convention of an Audio Engineering Society (AES), Nov. 3-6, 1978, New York.

However, all the known phasing plug designs suffer from several problems. Considering their design, the magnet 120, the first pole piece 110, and the second pole piece 116 are commonly located on the front side of the phasing plug 102. The voice coil 122 is disposed within the air gap between the first pole piece 110 and the second pole piece 116.

Ideally, the air gap should be made as narrow as is practicable since reluctance in the magnetic circuit increases as a square function of the width of the gap, lowering the magnetic flux density in the air gap rapidly as the dimension is increased. Nevertheless, there is a region, comprising a considerable volume of air in the air gap surrounding the voice coil 122 as well as in the spaces along the inner circumference of the surround 124 and outer circumference of the diaphragm 108. Because this region is far from the inlets of the phasing plug air channels, the variations of air pressure in that region are coupled negligibly, i.e., little or not at all, to the phasing plug 102 and; consequently the transducer's exit 128. As such the pressure variations do not contribute to the generation of sound output, and cause energy losses in the form of heat.

In addition, the uncoupled region also causes cavity resonance effects which distort the overall sound output of the speaker due to anomalies in its frequency response. The problem is treated in, e.g., Kinoshita, et al.: "The Influence of Parasitic Resonances on Compression Driver Loudspeaker Performance", 61st Convention of the Audio Engineering Society in 1978.

The ideal behavior of a diaphragm movement would be a purely pistonic motion over the entire area of the diaphragm in response to forces imposed upon it by the input signal, over the entire range of audio frequencies being reproduced by the transducer. However, this is and ideal, and can not be achieved in practice. In general, above a certain audio frequency, the diaphragm begins to deform, and portions of the diaphragm move non-pistonically. This deformation results in creation of signals not present in the input signal (a distortion).

As the frequency increases, the properties of the diaphragm, e.g., the mass and lack of stiffness, cause region(s) of the diaphragm to decouple, i.e., fail to follow the motion of the voice coil. Only the region of the diaphragm in proximity to the voice coil is coupled, and follows the motion of the voice coil faithfully. This results in a decline in a power response of the transducer, especially at higher frequencies.

The decoupling effect has been extensively studied in the art; e.g., William F. Boyce: Hi Fi Stereo Handbook, second edition, October 1964; Abraham B. Cohen: Hi Fi Loudspeakers and Enclosures, revised second edition, 1978. Hence, determining the region of the diaphragm that is not decoupled is a routine engineering task once required design criteria, including, but not being limited to highest frequency of operation, properties of the diaphragm, i.e., shape, size and construction, have been established.

An increased compression ratio may compensate for the decline in the power response; however, the bandwidth of uniform power response is narrowed and generally moved higher in frequency. Furthermore, the above-described decoupling effects are increased.

At least one design attempt, a U.S. Pat. No. 2,832,844, entitled "Speaker Driver", addressed the above-identified problems of minimizing the air gap and cavity resonances of air gap volume by re-locating the magnetic circuit and the voice coil at the rear side of the phasing plug. However, the effects of uncoupled region and decoupling effects were not solved.

A U.S. Pat. No. 5,177,462, entitled "Phasing Plug for Compression Driver", expressly rejected the approach taken by U.S. Pat. No. 2,832,844, and instead addressed some of the above-identified problems by creating an "auxiliary air passage" from the air gap. However, adding the auxiliary air passage in the vicinity of the voice coil causes the necessity to replace part of the magnetic circuit with a magnet embedded in the phasing plug. As such, the magnet is necessarily small, resulting in a weaker magnetic field. Furthermore, the air passage itself adds reluctance to the magnetic circuit. To minimize this added reluctance, the auxiliary air passage should take up no more volume than necessary, which compromises the optimal shape and size of the auxiliary air passage.

SUMMARY OF THE INVENTION

The invention aims to address the at least some of the above-identified and related problems. The features of the invention are set forth with particularity in the appended claims and together with advantages thereof will become clearer from consideration of the following detailed description of an exemplary embodiment of the invention given with reference to the accompanying drawings.

DETAILED DESCRIPTION

Figure 1:
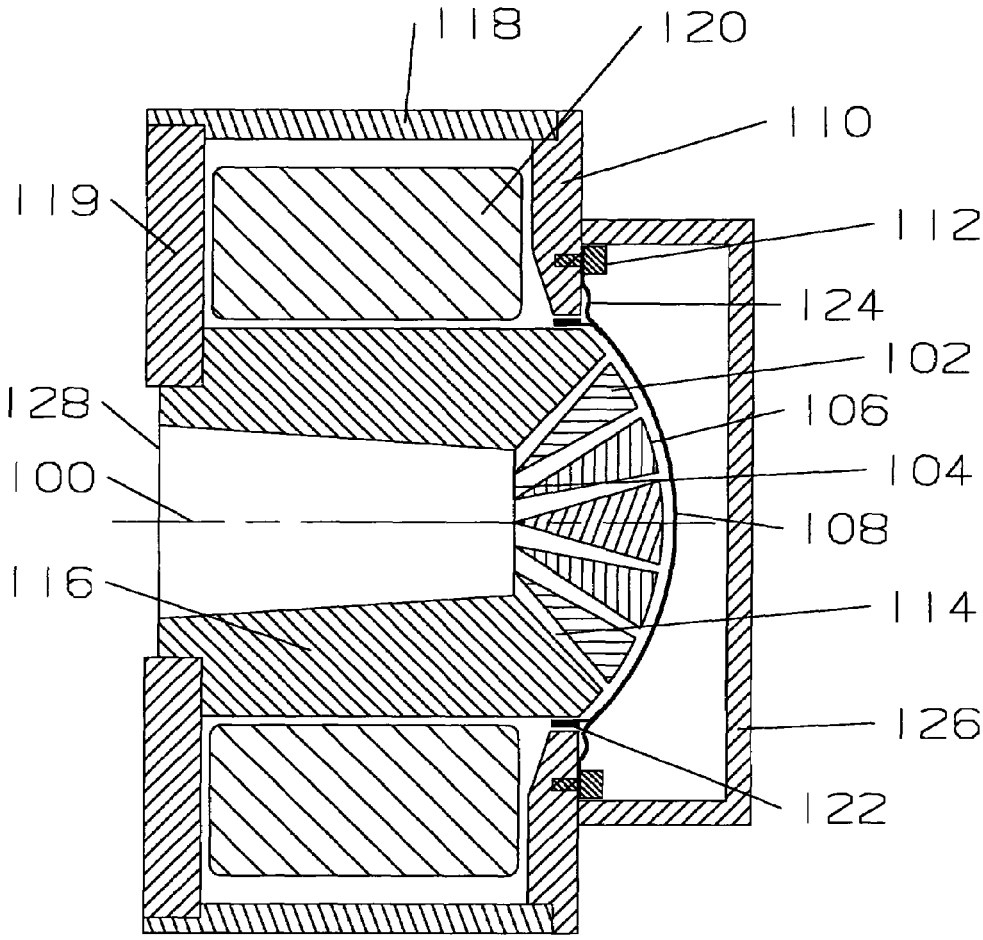
PRIOR ART FIG 1
FIG. 1 illustrates a cross-sectional view of a conceptual design of a prior art compression driver.
Figure 2:
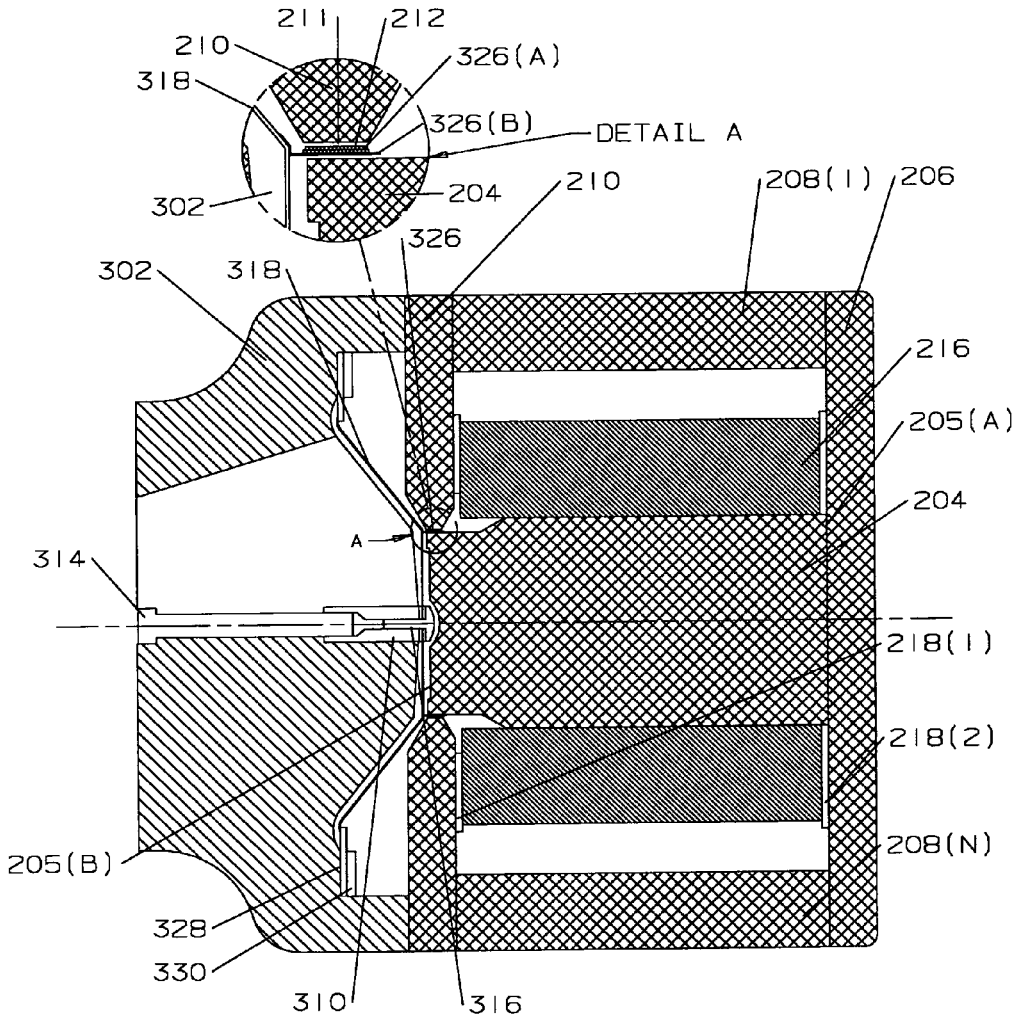
FIG. 2 illustrates a cross-sectional view of a conceptual design of a compression driver.

Turning now to FIG. 2 of the accompanying drawings, there is shown a conceptual design of a transducer 202.

A structure providing a magnetic circuit for the transducer 202 comprises a cylindrically-shaped inner pole piece 204, attached at one end 205*a* to a base plate 206. The other end 205*b* of the inner pole piece 204 has a diameter reduced below an inner diameter of a voice coil assembly 326. An annular outer pole piece 210 with an inner diameter greater that the outer diameter of the voice coil assembly 326 is positioned in such a spatial relationship to the other end 205*b* of the inner pole piece 204 that an air gap 211 is created by the difference between the reduced outer diameter of the inner pole piece 204 and the inner diameter of the outer pole piece 210. The air gap 211 is illustrated in greater detail in the detailed drawing A.

The spatial relationship between the inner pole piece 204 and the outer pole piece 210 is defined by a plurality of cylindrically-shaped stand-offs 208(1)-208(*n*), attached to the outer periphery of the base plate 206. In one embodiment, there are eight standoffs (n=8). The members of the magnetic circuit structure are attached by means of fasteners, e.g., screws. However, any other means for attachment, facilitating a low magnetic reluctance between the different members are contemplated and are; therefore, within the scope of the disclosed concepts.

A coil 216 wound around the inner pole piece 204, is secured between the base plate 206 and the annular outer pole piece 210 by means of annulus-shaped compressible spacers 218(1) and 218(2). When connected to a supply (not shown) of electric energy, the coil 216 generates a magnetic flux in the magnetic circuit. However, other techniques for generating the magnetic flux, e.g., by means of permanent magnets, are contemplated and are; therefore, within the scope of the disclosed concepts. The magnetic flux produces a magnetic flux density in the air gap 211 between the inner pole piece 204 and the annular outer pole piece 210.

Referring to the detailed drawing A, the inner diameter area of the outer pole piece 210 is tapered to form a reduced outer pole tip 212 to concentrate the magnetic flux into the gap. The voice coil assembly 326 comprises a voice coil 326*a* wound around a former 326*b*. The outer section of the former 326*b* is attached to a non-compression side of the diaphragm 318; the inner section of the former 326*b* with the voice coil 326*a* is disposed into the air gap 211.

A sub-assembly, comprising an acoustic transformer 302 with an attached diaphragm 318/voice coil 326 assembly, is affixed to the above described magnetic circuit structure. A cross-sectional view of a conceptual design of such a sub-assembly is shown in FIG. 3 of the accompanying drawings.

Figure 3:
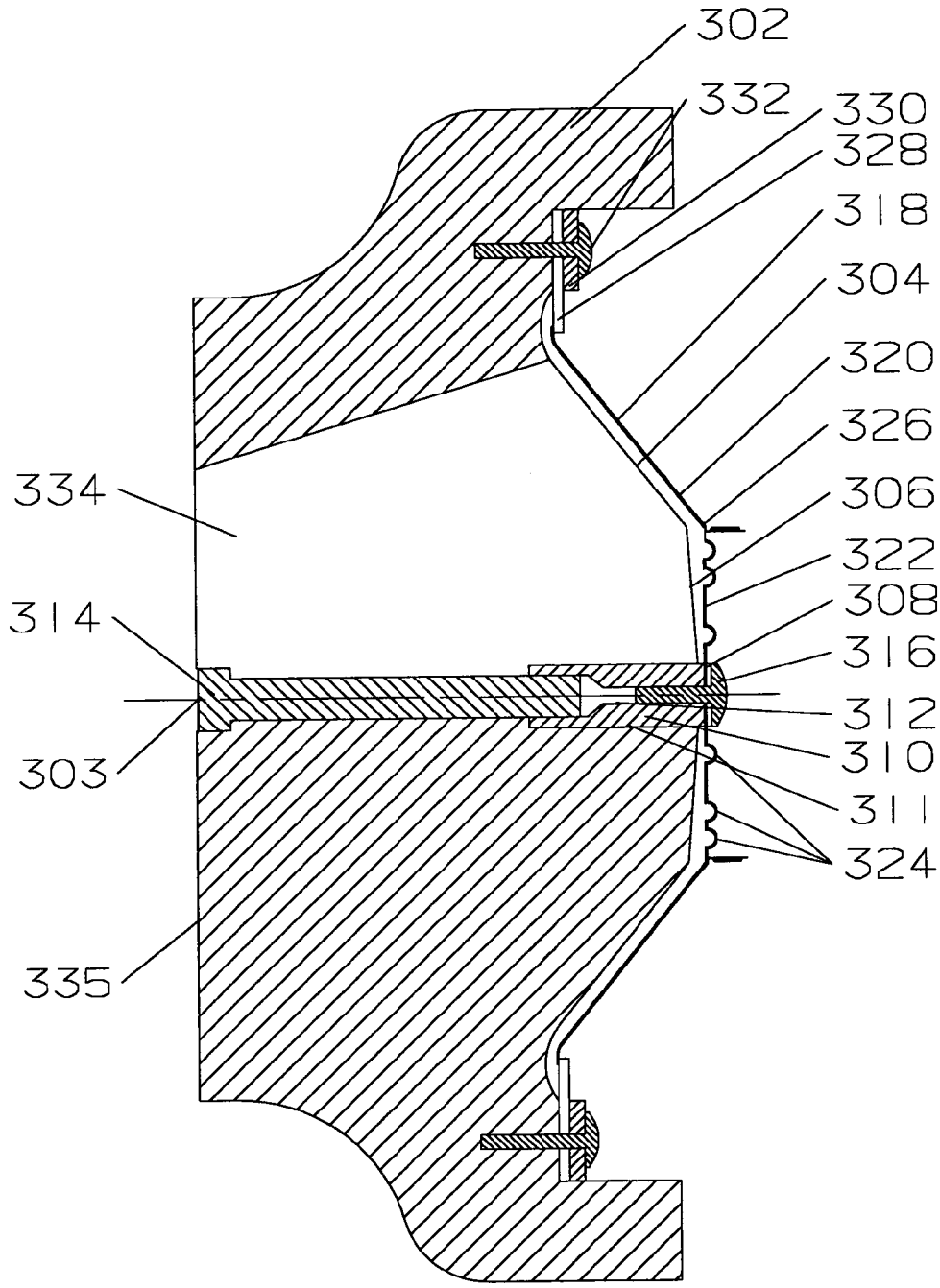
FIG. 3 illustrates a cross-sectional view of a conceptual design of a sub-assembly comprising an acoustic transformer and diaphragm/voice coil assembly of the compression driver of FIG. 2.

Referring now to FIG. 3, as illustrated, the sub-assembly possesses rotation symmetry about an axis 303. A rear face of the acoustic transformer 302 is formed by a first conically shaped surface 304 with a first included angle. As illustrated, the first included angle is 103 deg; however, other angles may be used as a matter of design choice.

The first conically shaped surface 304 is truncated by a second conically shaped surface 306 with a second included angle, wherein the second include angle is greater than the first included angle. As shown, the second included angle is 172 deg; however, other angles may be used as a matter of design choice.

The rear face of the acoustic transformer 302 is shaped correspondingly to the shape of a compression side of the diaphragm 318, with a clearance between the rear face and the diaphragm 318 being defined to allow only enough room for the diaphragm to move through the diaphragm's intended range without physical interference with the rear face. Therefore, should another shape of the compression side of a diaphragm than a first conical shape truncated by a second conical shape be desired, the rear face of the acoustic transformer 302 will be formed accordingly. The first shaped surface and the second shaped surface do not need to have the same shape, but may comprise any combination of concentrically arranged shapes. Furthermore, the rear face of the acoustic transformer 302 may comprise other than two surfaces, including only one surface. Exemplary shapes for diaphragms or surfaces of diaphragms are curvilinear, dome, planar, and any other shapes known in the art.

The second conically shaped surface 306 is further optionally truncated by a flat surface 308 formed by an insert 310, which is threaded into a first passage 311 with threaded walls formed in the acoustic transformer 302. The clearance between a diaphragm 318 and the rear face of the acoustic transformer 302 is controlled by threading the insert 310 in or out of the first passage 311. In the center of the insert 310 is formed a second threaded passage 312. The second threaded passage 312 accepts a first fastener 314, which prevents movement of the insert 310 relative to the acoustic transformer 302, once the required clearance was established. A second fastener 316 affixes the diaphragm 318 to the insert 310.

Alternatively, the insert 310 need not be used and the flat surface 308 with the threaded passage 312 is instead machined as a part of the second conically shaped surface 306.

The diaphragm 318 is shaped substantially to follow the shape of the rear face of the acoustic transformer 302. Accordingly, the diaphragm 318 comprises a first conically shaped section 320 with a first included angle. As shown, the first included angle is 103 deg; however, other angles may be used as a matter of design choice. The first conically shaped section 320 may optionally comprise a flared lip adapted to be affixed to the acoustic transformer 302.

The first conically shaped section 320 is truncated by a second conically shaped section 322 with a second included angle, wherein the second include angle is greater than the first included angle. As shown, the second included angle is 180 deg; however, other angles may be used as a matter of design choice. The second conically shaped section 322 of the diaphragm 318 may optionally contain several annular corrugations 324, which function as hinges to provide adequate freedom of movement to the diaphragm.

The diaphragm 318 is affixed to the acoustic transformer 302 at its outer circumference. As illustrated, the outer circumference of the diaphragm 318 (comprising optionally the flared lip), is glued to an annulus 328, which is clamped about the annulus' outer circumference by a clamping annulus 330 by means of a plurality of fasteners 332. The annulus 328 functions as a suspension as well as locating device for the diaphragm 318. Accordingly, a desired behavior of the suspension may be achieved by a proper selection of the material for the annulus 328, e.g., a cloth, a felt, leather, or any other material, which provides a compliance of the diaphragm required by particular design criteria. This type of suspension is known as a flat suspension.

However, other types of suspension known in the art, e.g., a half-roll suspension, a tangential suspension, a diamond pattern suspension, may be used when required by design criteria.

As described in reference to FIG. 2, the voice coil assembly 326 (comprising a voice coil 326*a*, wound around a former 326*b*), is attached via the former 326*b* to the non-compression side of the diaphragm 318, so that the section of the voice coil assembly 326 that is not attached to the diaphragm 318 is facing away from the acoustic transformer 302. Furthermore, the voice coil assembly 326 is attached between the outer circumference of the diaphragm 318 and the border defined by intersection of the diaphragm 318 with the flat portion 308. In other words, a circumference of the voice coil assembly 326, defined by its diameter, is smaller than the outer circumference of the diaphragm 318. As shown, the voice coil 326 is attached at the boundary between the first conically shaped section 320 and the second conically shaped section 322.

The center of the diaphragm 318/voice coil 326 assembly is affixed by a fastener 316 to the flat section 308 of the acoustic transformer 302 thus providing a reliable means for centering the diaphragm 318/voice coil assembly 326 in the air gap 211 (shown in FIG. 2).

By means of this arrangement, the voice coil assembly 326 does not interfere with the acoustic transformer 302. Consequently, inlets of air channels may be arranged to intersect any region of the rear face of the acoustic transformer 302, thus minimizing or preventing occurrence of uncoupled region(s) and preventing distortion due to undesirable effects of cavity resonances. Additionally, by appropriate arrangement of the inlets of the air channels as described in detail below, the decoupling effects can be at least mitigated.

As can be seen in FIG. 3, a plurality of voids 334 is formed between the rear face and a front face 335 of the acoustic transformer 302 to provide a plurality of the air channels. A plurality of inlets 336 (not shown) of the air channels is created by intersections of the plurality of voids 334 with the rear face of the acoustic transformer 302. Because the voice coil assembly 326 does not interfere with the acoustic transformer 302, the plurality of voids 334 may be arranged to intersect any region of the rear face of the acoustic transformer 302, including the region of or even past the outer circumference of the diaphragm 318, thus minimizing or preventing occurrence of uncoupled region.

Furthermore, the plurality of voids 334 is arranged to provide different compression ratios over different areas of the diaphragm 318. Due to decoupling effects at high frequencies, only a region of the diaphragm 318 in a proximity to the voice coil 326, i.e., the area defined by the coupled region, is coupled, and follows the motion of the voice coil faithfully. By increasing the compression ratio in the proximity to the voice coil 326, the decoupling effects (a decline in a power response of the transducer), are mitigated. Because the compression ratio in the remaining area of diaphragm 318 is not altered from its optimum, the bandwidth of uniform power response is not affected, and the decoupling effects are not increased.

Figure 4:
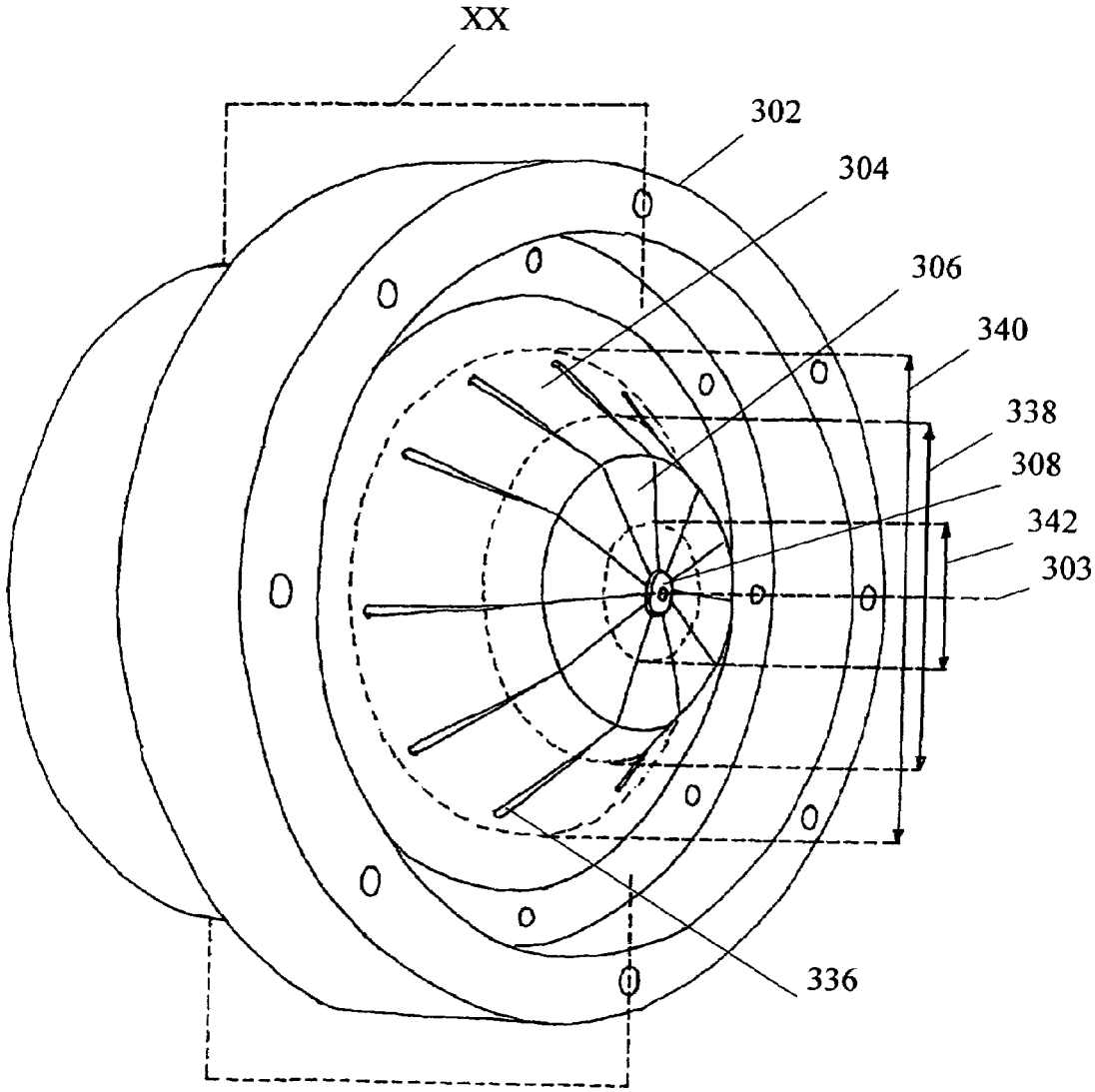
FIG. 4 illustrates a rear isometric view of the acoustic transformer of FIG. 3.

One suitable arrangement of the plurality of voids 334 is illustrated in FIG. 4. In FIG. 4, the reference XX indicates a plane of the cross-sectional view of the acoustic transformer 302 illustrated in FIG. 3. As shown, the plurality of voids 334 is arranged as radii about the axis of symmetry, said arrangement providing an acoustic transformer 302 known as a radial phasing plug.

As illustrated, the plurality of voids 334 intersects both the first conically shaped surface 304 and the second conically shaped surface 306; the intersection forming a plurality of inlets 336. Because the voice coil 326 (not shown), is located at or about the intersection of the first conically shaped surface 304 and the second conically shaped surface 306, the inlets 336, traverse the surface defined by the diameter of the voice coil 326, thus providing a plurality of air channels in this area.

To minimize or prevent occurrence of uncoupled region, the plurality of inlets 336 is extended to a region of the rear face of the acoustic transformer 302 defined by a diameter 338. As shown, the diameter 338 is smaller than a diameter defining the outer circumference of the diaphragm 318 (not shown). Alternatively, the plurality of inlets 336 may be extended to or even past the outer circumference of the diaphragm 318 (not shown).

To mitigate the decoupling effects, a higher compression ratio is provided in the proximity of the voice coil 326, i.e., in an area defined by the coupled region, compared to a compression ratio provided in at least a portion of the remaining area of the diaphragm 318 (not shown). Because a compression ratio is defined as a ratio of the total diaphragm area to the total cross-section area of the air channels; once a shape and dimensions of a diaphragm are determined; therefore, becoming constant, the desired compression ratio is defined by the cross-section area of the inlets 336. Consequently, once the areas (the proximity of the voice coil 326 and at least a portion of the remaining area of the diaphragm 318 (not shown)), and associated desired compression ratios are designed, the cross-section areas of the inlets 336 in the respective areas defines the desired compression ratios. The shape of the inlets 336, determining their cross-section area, may be constant or may vary uniformly or non-uniformly over the respective areas of the diaphragm 318 (not shown).

In FIG. 4 two areas with two associated compression ratios may be defined. The first compression ratio is provided in the proximity of the voice coil 326 (not shown), i.e., within the first area formed by a diameter 338, greater than the diameter of the voice coil 326 (not shown). The first compression ratio is provided by determining the desired cross-section area of the inlets 336 in that area. As shown, the desired cross-section area is implemented by constant width inlets 336.

The second compression ratio is provided in the second—remaining—area of the diaphragm defined as a belt between the diameters 338 and 340. The second compression ratio is provided by determining the desired cross-section area of the inlets 336 in that area. As shown, the desired cross-section area is implemented by inlets 336, with non-uniformly shaped cross-section areas.

Because the design goal is to provide a higher compression ratio in the proximity of the voice coil 326 (not shown), the first compression ratio is greater than the second compression ratio.

Alternatively, there may be more than two areas, each such an area having an associated compression ratio. To mitigate the decoupling effects, the area in the proximity of a voice coil has a higher compression ratio than at least one of the remaining areas of the diaphragm. Thus, referring again to FIG. 4, a first area is a first band between diameters 338 and 340, a second area is a second band between diameters 340 and 342, and third area is defined to be within diameter 342. Because the diameter of the voice coil 326 (not shown) is smaller than the diameter 338, but greater than diameter 342, the second area is in the proximity of the voice coil 326 (not shown). Therefore, the second area has higher compression ratio than at least one of the two remaining areas, e.g., the first area.

The compression ratio in the remaining area, i.e., the third area is a design choice. For example, as illustrated, the compression ratio in this third area is approximately equal to the compression ratio in the second area. However, since the movement of the diaphragm 318 (not shown) in this area is limited, another design choice could set this compression ratio equal to zero.

Figure 5:
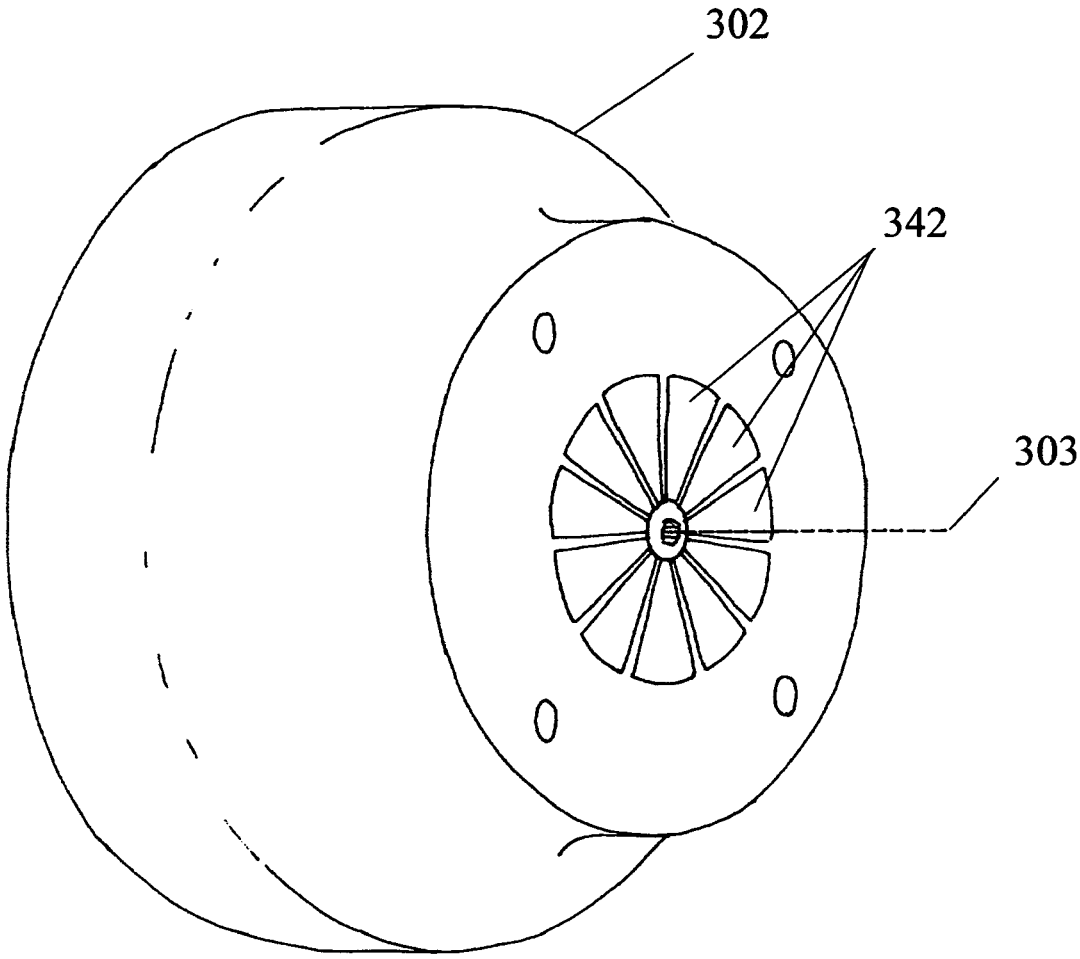
FIG. 5 illustrates a front isometric view of the acoustic transformer of FIG. 3.

As the voids 334 progress from the rear face to the front face of the acoustic transformer 302, the voids expand from the shapes defined by the inlets 336 at the rear face to outlets 342 at the front face. As illustrated, the outlets 342 having a shape of a truncated isosceles triangle with a vertex of said triangle located about the axis 303. As illustrated FIG. 5, the truncating portion is a line. However, other truncating shapes, e.g., arch, opposite isosceles triangle, and other shapes may be used.

The above-described concepts may be equally applied to a circumferential phasing plug. As well known, in a circumferential phasing plug, the plurality of voids 334 is arranged to intersect the rear face of the acoustic transformer 302 as a plurality of inlets (not shown) formed by a plurality of circles. The plurality of circles is defined by radii about the axis of symmetry; the radii increasing in the direction away from the flat portion 308.

Because the voice coil assembly 326 does not interfere with the acoustic transformer 302, the plurality of voids may be arranged to intersect any region of the rear face of the acoustic transformer 302, including the region of or even past the outer circumference of the diaphragm 318, thus minimizing or preventing occurrence of uncoupled region.

Furthermore, to mitigate the decoupling effects, the area in the proximity of a voice coil has a higher compression ratio than at least one of the remaining areas of the diaphragm. Consequently, the plurality of voids 334 is arranged to provide different compression ratios over different areas of the diaphragm 318 (not shown).

In FIG. 4 two areas with two associated compression ratios may be defined. A first area in the proximity of the voice coil 326 (not shown), i.e., within the area formed by a diameter 338, greater than the diameter of the voice coil 326 (not shown). A second—remaining—area of the diaphragm 318 (not shown) is defined as a band between the diameters 338 and 340. Because in circumferential phasing plug the plurality of inlets is formed by a plurality of coaxial circles, the width of the inlets determines the cross-section area. Therefore, the width of the inlets is selected to define a first compression ratio within the first area, and a second compression ratio in the second area. Because the design goal is to provide a higher compression ratio in the proximity of the voice coil 326 (not shown), the first compression ratio is greater than the second compression ratio.

Alternatively, there may be more than two areas, each such an area having an associated compression ratio. As an example, the width of the inlets is selected to define a first compression ratio within a first area defined as a first band between diameters 338 and 342; a second compression ratio in a second area defined as a second band between the diameters 340 and 342; and third compression ratio in a third area defined within diameter 342. Because the diameter of the voice coil 326 (not shown) is smaller than the diameter 340, but greater than the diameter 342, the second area is in the proximity of the voice coil 326 (not shown). Therefore, the second area has higher compression ratio than at least one of the two remaining areas, e.g., the first area. The compression ratio in the remaining area, i.e., the third area is again a design choice.

Figure 6:
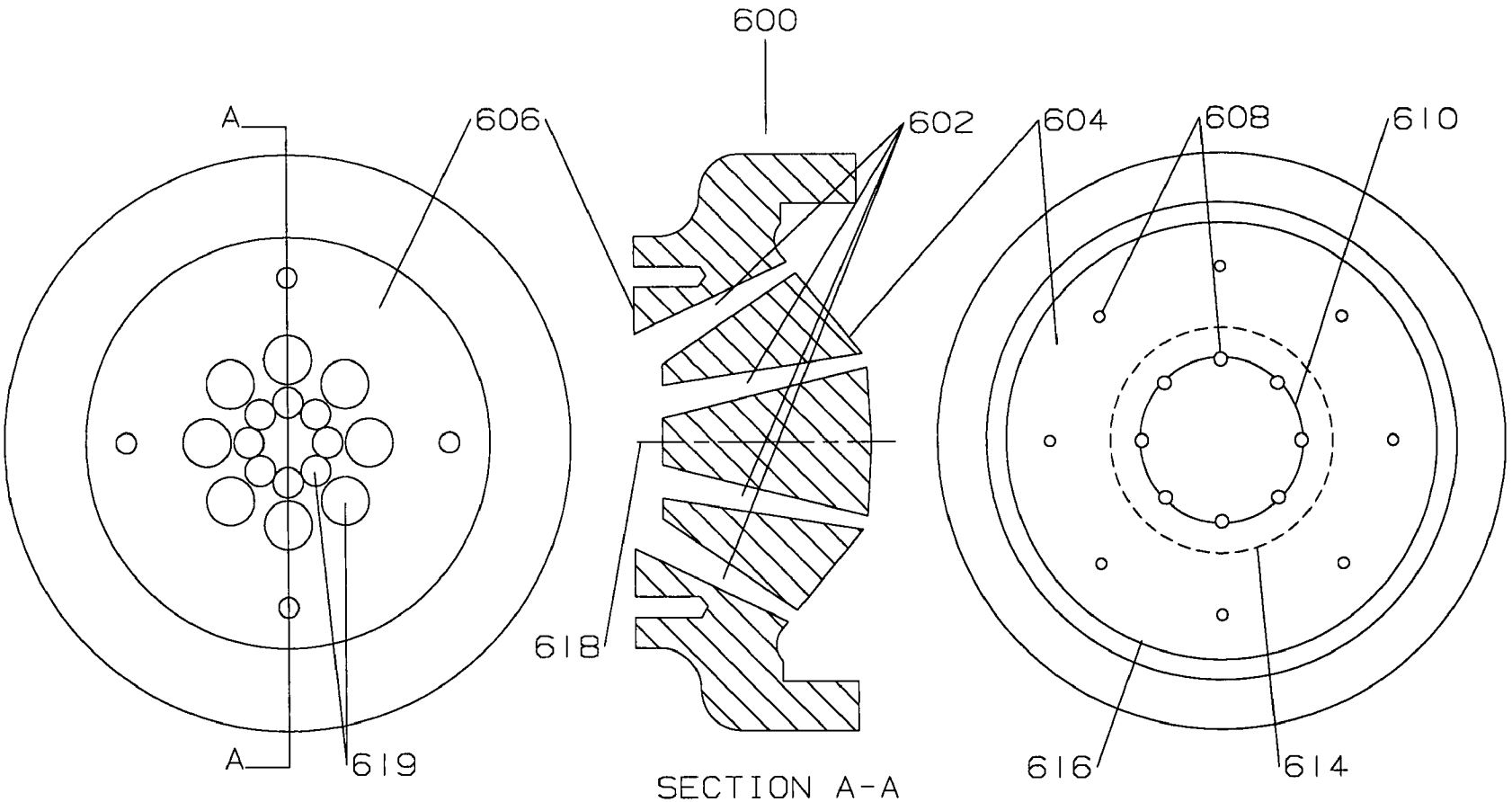
FIG. 6 illustrates a conceptual design of an alternative acoustic transformer of the compression driver of FIG. 2.

Similarly, the above-described concepts may be equally applied to a salt shaker acoustic transformer. FIG. 6 illustrates a conceptual design of such an acoustic transformer of the compression driver of FIG. 2. A plurality of voids 602 is formed between a rear face 604 and a front face 606 of the acoustic transformer 600 to provide a plurality of the air channels.

As illustrated, the plurality of voids 602 intersects the rear face 604; the intersection forming a plurality of inlets 608. The plurality of inlets 608 is arranged to provide a first total cross-section area in the proximity of the voice coil 326 (not shown), i.e., in the area defined by the coupled region; and to provide a second total cross-section area in at least a portion of the remaining area of the rear face 604.

In one suitable arrangement, the first area is defined to be within a diameter 614, greater than the diameter 610 of the voice coil 326 (not shown). The first compression ratio is determined as a ratio of total cross-section area of those of the plurality of inlets 608 in the proximity of the voice coil to the total area in the proximity of the voice coil. Consequently, the first compression ratio is provided in the proximity of the voice coil 326 (not shown).

However, other possible arrangements of the plurality of voids 602 providing the required first compression ratio are within the scope of the disclosed concepts. As an example, one such arrangement of voids 602 creates an alternating pattern of inlets 608 in the proximity of the voice coil 326 (not shown), e.g., one inlet 608 within a circle 610 the next inlet 608 without the circle 610 but within the circle 614 and so forth:

The second—remaining—area of the diaphragm is a band between the diameters 614 and 616. The second compression ratio is determined as a ratio of those of the plurality of inlets 608 in the area between the diameters 614 and 616 to the total area between the diameters 614 and 616.

However, other possible arrangements of the plurality of voids 602 providing the required second compression ratio are within the scope of the disclosed concepts. As an example, the plurality of voids 602 is arranged to intersect said rear face as a plurality of inlets 608 arranged on a multitude of radii about the axis of symmetry 618. In another example, the plurality of voids 602 is arranged to intersect said rear face as a plurality of inlets 608 arranged on a multitude of circles defined by radii about the axis of symmetry 618.

Because the design goal is to provide a higher compression ratio in the proximity of the voice coil 326 (not shown), the first compression ratio is greater than the second compression ratio.

Alternatively, there may be more than two areas, each such an area having an associated compression ratio. To mitigate the decoupling effects, the area in the proximity of a voice coil has a higher compression ratio than at least one of the remaining areas of the diaphragm. Thus, a first area is a first belt between the diameters 614 and 616, a second area is a second belt between diameters 614 and 612, and third area is defined to be within diameter 612. Because the diameter of the voice coil 326 (not shown) is smaller than the diameter 614, but greater than diameter 612, the second area is in the proximity of the voice coil 326 (not shown). Therefore, the second area has higher compression ratio than at least one of the two remaining areas, e.g., the first area.

The compression ratio in the remaining area, i.e., the third area is a design choice.

The plurality of voids 602 intersects the front face 606 in a plurality of outlets 619. As illustrated the plurality of voids 602 is substantially conically shaped, with an included angle of those of the plurality of inlets 608 in the proximity of the voice coil being greater than an included angle of those of the plurality of inlets 608 without the proximity of the voice coil. Furthermore, the front face 606 of the acoustic transformer 600 is recessed to provide path length equalization. The term "substantially" includes shapes like cone, polyhedron pyramid, and wedge. However, other shapes, e.g., cylinder, may be used as long as the required compression ratios and path equalization in accordance with the disclosed concepts is achieved.

Having thus described the invention by reference to preferred embodiments it is to be well understood that the embodiments in question are exemplary only and that modifications and variations such as will occur to those possessed of appropriate knowledge and skills may be made without departure from the spirit and scope of the invention as set forth in the appended claims and equivalents thereof. Thus, the present invention is not intended to be limited to the embodiments shown herein but is to be accorded the widest scope consistent with the principles and novel features disclosed herein.

We claim:

1. An apparatus for acoustic loading of a diaphragm having a voice coil with a circumference defined by a first diameter affixed on a non-compression side, the voice coil's circumference being smaller than the diaphragm's outer circumference, the apparatus comprising:

a rear face having a shape corresponding to a shape of a compression side of the diaphragm;

a front face opposite to said rear face along an axis of symmetry; and a plurality of voids formed between said rear face and said front face, wherein said plurality of voids intersects said rear face as a plurality of inlets, said plurality of inlets having a first total cross-section area defining a first compression ratio in a proximity of the first diameter, and a second total cross-section area defining a second compression ratio in at least a portion of the remaining area of said rear face, wherein the first compression ratio is greater than the second compression ratio.

2. The apparatus as claimed in claim 1 wherein the proximity comprises:

an area within a second diameter, wherein the second diameter is greater than the first diameter.

3. The apparatus as claimed in claim 1 wherein the proximity comprises:

an area defined by a band between a second diameter and a third diameter, wherein the first diameter is smaller than the second diameter and greater than the third diameter.

4. The apparatus as claimed in claim 1 wherein said plurality of voids is arranged to intersect said rear face as a plurality of circles with different radii about the axis of symmetry.

5. The apparatus as claimed in claim 1 wherein said plurality of voids is arranged to intersect said rear face as a plurality of radii about the axis of symmetry.

6. The apparatus for as claimed in claim 5, wherein the plurality of inlets have the first cross-section area in an area traversing a surface defined by the first diameter.

7. The apparatus as claimed in claim 5 wherein said plurality of voids intersect said front face in a plurality of outlets, the outlets having a shape of a truncated isosceles triangle with a vertex of said triangle located about the axis of symmetry.

8. The apparatus as claimed in claim 1 wherein said plurality of voids is arranged to intersect said rear face on a multitude of radii about the axis of symmetry.

9. The apparatus as claimed in claim 8 wherein the plurality of voids is arranged to intersect said rear face on a multitude of circles with different radii about the axis of symmetry.

10. The apparatus as claimed in claim 8 wherein said plurality of voids is substantially conically shaped.

11. The apparatus as claimed in claim 8 wherein at least two voids of said plurality of voids have a first included angle; and remaining voids have a second include angle.

12. The apparatus as claimed in claim 1 wherein said rear face has a shape of a truncated cone.

* * * * *